US008307799B2

(12) United States Patent
Shin

(10) Patent No.: US 8,307,799 B2
(45) Date of Patent: Nov. 13, 2012

(54) LUBRICATION SYSTEM FOR FUEL PUMP OF GDI ENGINE

(75) Inventor: Bosung Shin, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 180 days.

(21) Appl. No.: 12/834,560

(22) Filed: Jul. 12, 2010

(65) Prior Publication Data

US 2011/0100319 A1 May 5, 2011

(30) Foreign Application Priority Data

Nov. 5, 2009 (KR) ..... 10-2009-0106391

(51) Int. Cl.
*F01M 1/06* (2006.01)
*F02M 37/04* (2006.01)

(52) U.S. Cl. ..... 123/90.33; 123/196 R; 123/508

(58) Field of Classification Search ..... 123/508, 123/509, 196 R, 90.33
See application file for complete search history.

(56) References Cited

U.S. PATENT DOCUMENTS

| | | | | |
|---|---|---|---|---|
| 4,476,836 | A * | 10/1984 | Enomoto et al. | 123/502 |
| 4,538,561 | A * | 9/1985 | Amemori et al. | 123/90.44 |
| 4,696,265 | A | 9/1987 | Nohira | |
| 4,844,023 | A | 7/1989 | Konno et al. | |
| 5,398,658 | A * | 3/1995 | Mesimaki | 123/509 |
| 5,603,303 | A * | 2/1997 | Okajima et al. | 123/508 |
| 5,984,650 | A * | 11/1999 | Okubo et al. | 417/470 |
| 7,252,058 | B2 | 8/2007 | Tashiro | |
| 7,673,604 | B2 * | 3/2010 | Takane et al. | 123/90.34 |
| 2008/0110332 | A1 * | 5/2008 | Yi | 92/163 |
| 2010/0071655 | A1 * | 3/2010 | Kim | 123/196 R |
| 2010/0139610 | A1 * | 6/2010 | Park | 123/196 R |
| 2011/0030649 | A1 * | 2/2011 | Nagao | 123/196 R |
| 2011/0100319 | A1 * | 5/2011 | Shin | 123/196 R |
| 2011/0126793 | A1 * | 6/2011 | Ahn | 123/196 R |
| 2011/0146626 | A1 * | 6/2011 | Maruyama et al. | 123/495 |

FOREIGN PATENT DOCUMENTS

| | | | |
|---|---|---|---|
| JP | 58-5416 | A | 1/1983 |
| JP | 61-155608 | A | 7/1986 |
| JP | 05-312014 | A | 11/1993 |
| JP | 2006-307765 | A | 11/2006 |
| JP | 2009-062852 | A | 3/2009 |
| KR | 2003-0039131 | A | 5/2003 |
| KR | 10-2004-0104997 | A | 12/2004 |
| KR | 10-2005-0010438 | A | 1/2005 |
| KR | 10-2007-0009094 | A | 1/2007 |
| KR | 10-2009-0025654 | A | 3/2009 |
| KR | 10-2009-0052208 | A | 5/2009 |
| KR | 1020090064095 | * | 6/2009 |

* cited by examiner

*Primary Examiner* — Thomas Moulis
(74) *Attorney, Agent, or Firm* — Morgan, Lewis & Bockius LLP

(57) ABSTRACT

A lubrication system for a fuel pump of an engine, may include at least one oil supply hole formed radially in a journal of a camshaft, an oil channel formed in a cam cap rotatably connected to the journal of the camshaft and selectively communicating with the at least one oil supply hole, a nozzle formed in the cam cap and being in fluid connection with the oil channel to inject oil to a contact portion between a pump-driving cam of the camshaft and an operational member of the fuel pump driven by the pump-driving cam, and a fluid communication control member selectively connecting the oil channel and the at least one oil supply hole in accordance with rotation of the camshaft.

7 Claims, 7 Drawing Sheets

LUBRICATION SYSTEM FOR FUEL PUMP OF GDI ENGINE

CROSS-REFERENCE TO RELATED APPLICATIONS

The present application claims priority to Korean Patent Application Number 10-2009-0106391 filed Nov. 5, 2009, the entire contents of which application is incorporated herein for all purposes by this reference.

BACKGROUND OF THE INVENTION

1. Field of the Invention

The present invention relates to a lubrication system for a fuel pump of a GDI "Gasoline Direct Injection") engine, in more detail, a technology about lubrication between a camshaft and a fuel pump in mechanism driving the fuel pump with the camshaft.

2. Description of Related Art

FIGS. 1 and 2 illustrate mechanism driving a fuel pump 500 of a GDI engine in the related art disposed through a cylinder head cover 502 with a camshaft 504.

Camshaft 504 has a pump-driving cam 506 for driving fuel pump 500 and the pump-driving cam 506 has four noses, such that it is possible to reciprocate the plunger of the fuel pump four times by one rotation.

A driving roller 508, an operational member for minimizing friction with the pump-driving cam is provided at the end of the fuel pump and lubrication oil should be smoothly supplied for appropriate lubrication on the contact surface between driving roller 508 and pump-driving cam 506 in order to ensure durability of the driving roller and the pump-driving cam.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a lubrication system for a fuel pump of a GDI engine making it possible to ensure durability of a fuel pump and a camshaft and smooth operability of the fuel pump and improve fuel efficiency of vehicles by minimizing the amount of supplied lubricant, by achieving continual, stable, and economical lubrication between a pump-driving cam of the camshaft for driving the fuel pump and an operational member transmitting power to the plunger of the fuel pump by the pump-driving cam.

In an aspect of the present invention, the lubrication system for a fuel pump of an engine, may include at least one oil supply hole formed radially in a journal of a camshaft, an oil channel formed in a cam cap rotatably connected to the journal of the camshaft and selectively communicating with the at least one oil supply hole, a nozzle formed in the cam cap and being in fluid connection with the oil channel to inject oil to a contact portion between a pump-driving cam of the camshaft and an operational member of the fuel pump driven by the pump-driving cam, and a fluid communication control member selectively connecting the oil channel and the at least one oil supply hole in accordance with rotation of the camshaft.

The camshaft may be hollow to form an oil passage therein and the at least one oil supply hole fluid-communicates with the oil passage of the camshaft.

The fluid communication control member may be a connection groove formed in a journal contact surface of the cam cap across the oil channel with a predetermined length along a rotational direction of the at least one oil supply hole to fluid-communicate with the oil channel, wherein an angle between both distal ends of the fluid communication control member with respect to a rotation axis of the camshaft is substantially the same as an angle between contact points of outer profile of at least one nose and a basic circle of the camshaft.

In another aspect of the present invention, the fluid communication control member may be a connection groove formed in a contact surface of the journal with the cam cap in a circumferential direction of the journal across the at least one oil supply hole to communicate with the at least one oil supply hole, wherein an angle between both distal ends of the fluid communication control member with respect to a rotation axis of the camshaft is substantially the same as an angle between contact points of outer profile of at least one nose and a basic circle of the camshaft.

At least one oil supply hole may be formed in the same number as at least one nose of the pump-driving cam in the protrusion direction of the at least one nose, and the connection groove allows the at least one oil supply hole to fluid-communicate with the oil channel only when the connection groove is disposed in an angular section between contact points of outer profile of the at least one nose and a basic circle of the pump-driving cam.

According to the present invention, it is possible to ensure durability of a fuel pump and a camshaft and smooth operability of the fuel pump and improve fuel efficiency of vehicles by minimizing the amount of supplied lubricant, by achieving continual, stable, and economical lubrication between a pump-driving cam of the camshaft for driving the fuel pump and an operational member transmitting power to the plunger of the fuel pump by the pump-driving cam.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
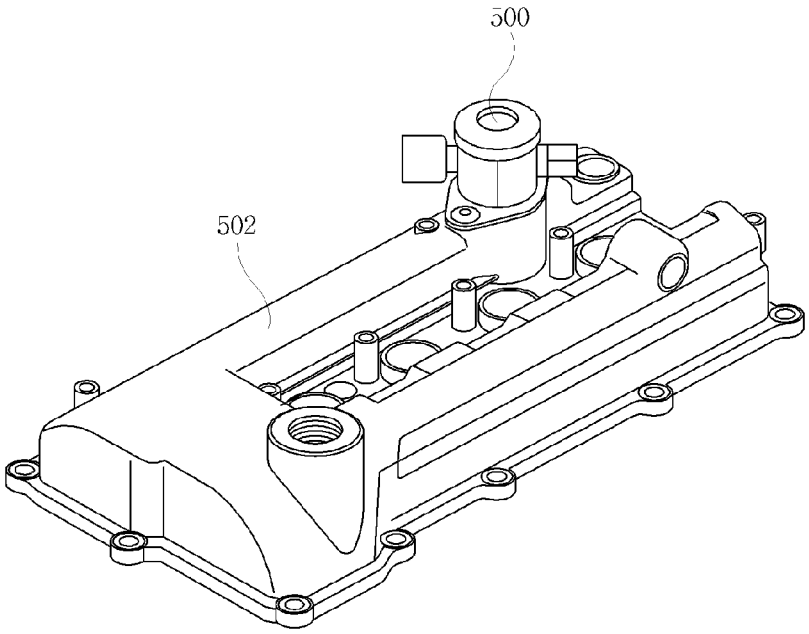
FIG.1 (Prior Art)
FIG. 1 is a view showing when a fuel pump is disposed through a cylinder head cover.
Figure 2:
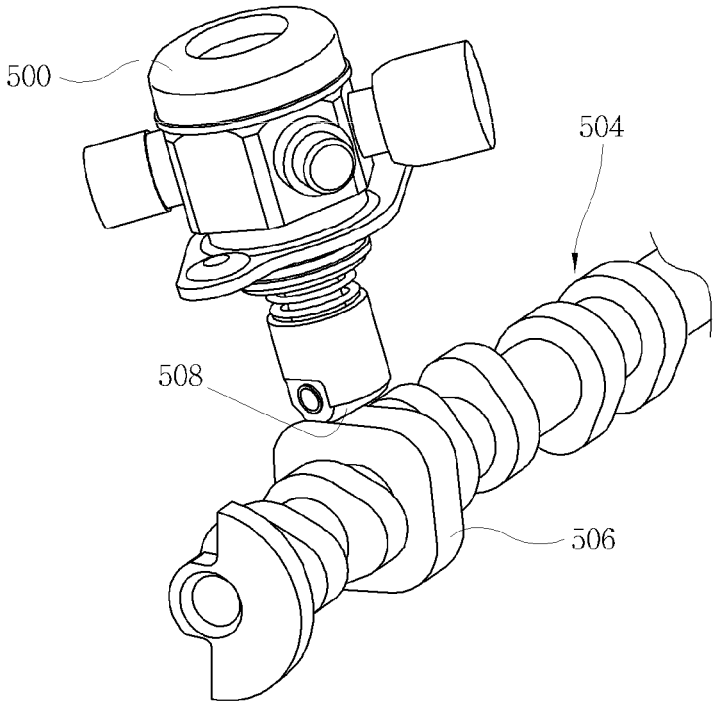
FIG.2 (Prior Art)
FIG. 2 is a view illustrating when the fuel pump is driven by a camshaft.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIGS. 3 to 6, an exemplary embodiment of the present invention includes, oil supply holes 5 formed radially in a journal 3 of a camshaft 1, an oil channel 9 communicating with oil supply holes 5 in a cam cap 7 rotatably connected to the cylinder head while covering the journal, a nozzle 15 formed in cam cap 7 in connection with the oil channel to inject oil to a contact portion between a pump-driving cam 11 of the camshaft and an operational member 13 of a fuel pump 12 driven by the pump-driving cam, and a fluid communication control means restricting the connection channel between oil channel 9 and oil supply holes 5 in rotation of camshaft 1.

In the present embodiment, the fluid communication control means is a connection groove 17 formed across oil channel 9 in the rotational direction of oil supply holes 5 on the journal contact surface of cam cap 7.

Figure 7:
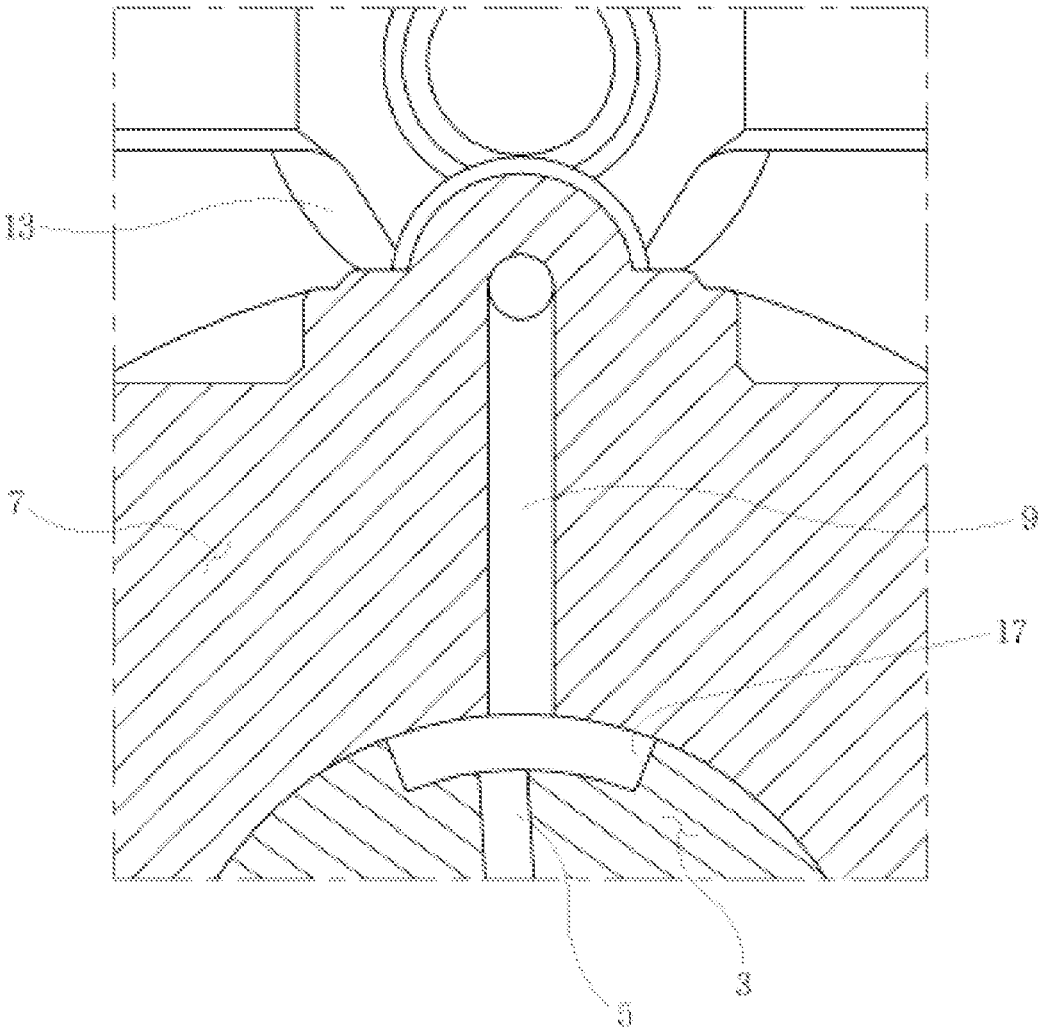
FIG. 7 is a view illustrating another exemplary lubrication system for a fuel pump of a GDI engine according to the present invention.

Alternatively, the fluid communication control means, contrary to the above configuration, may be a connection groove 17 formed to communicate with the oil supply holes 5 in the circumferential direction of the journal 3 on the cam cap contact surface of camshaft journal 3 as shown in FIG. 7.

Figure 3:
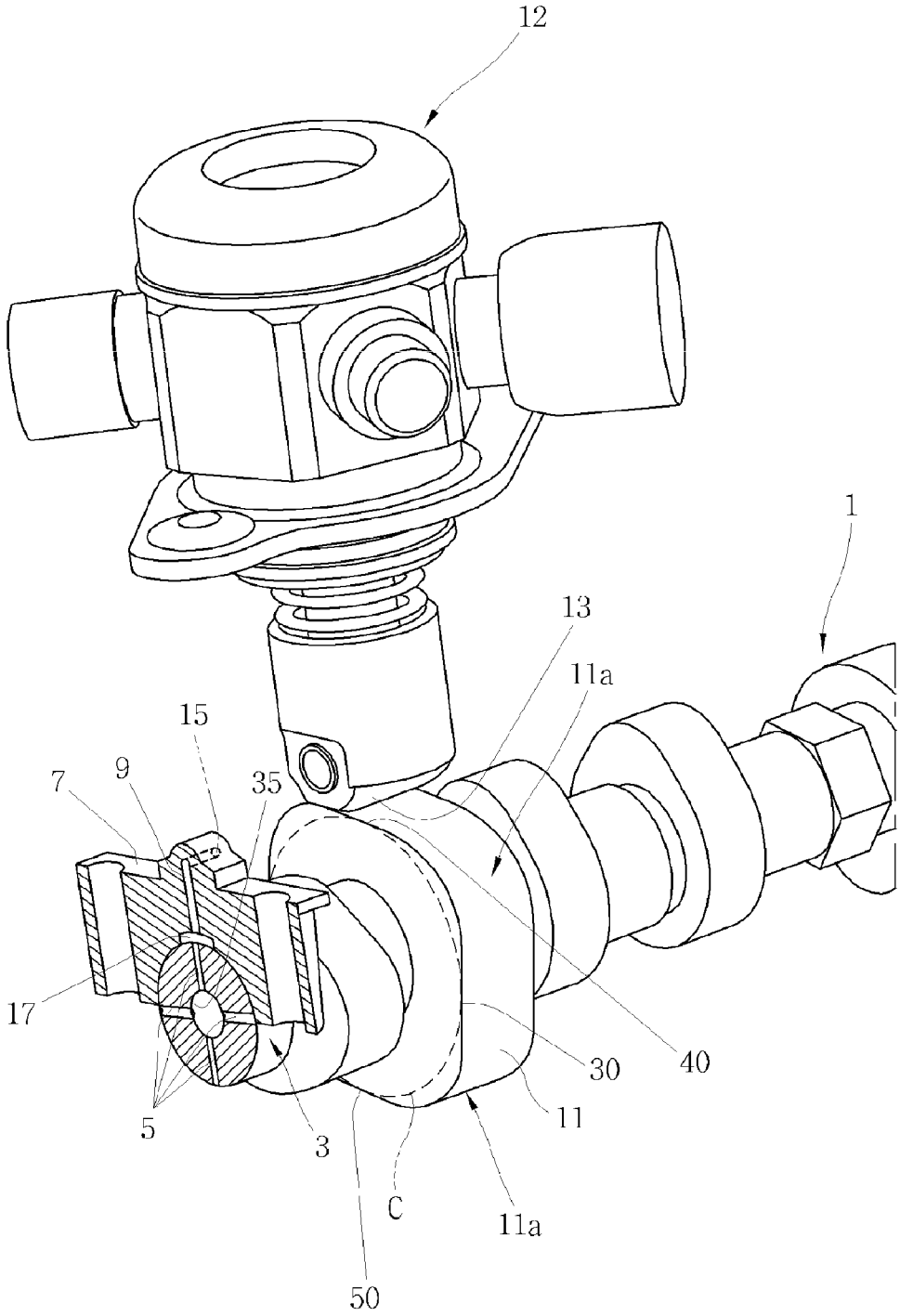
FIG. 3 is a view illustrating an exemplary lubrication system for a fuel pump of a GDI engine according to the present invention.
Figure 4:
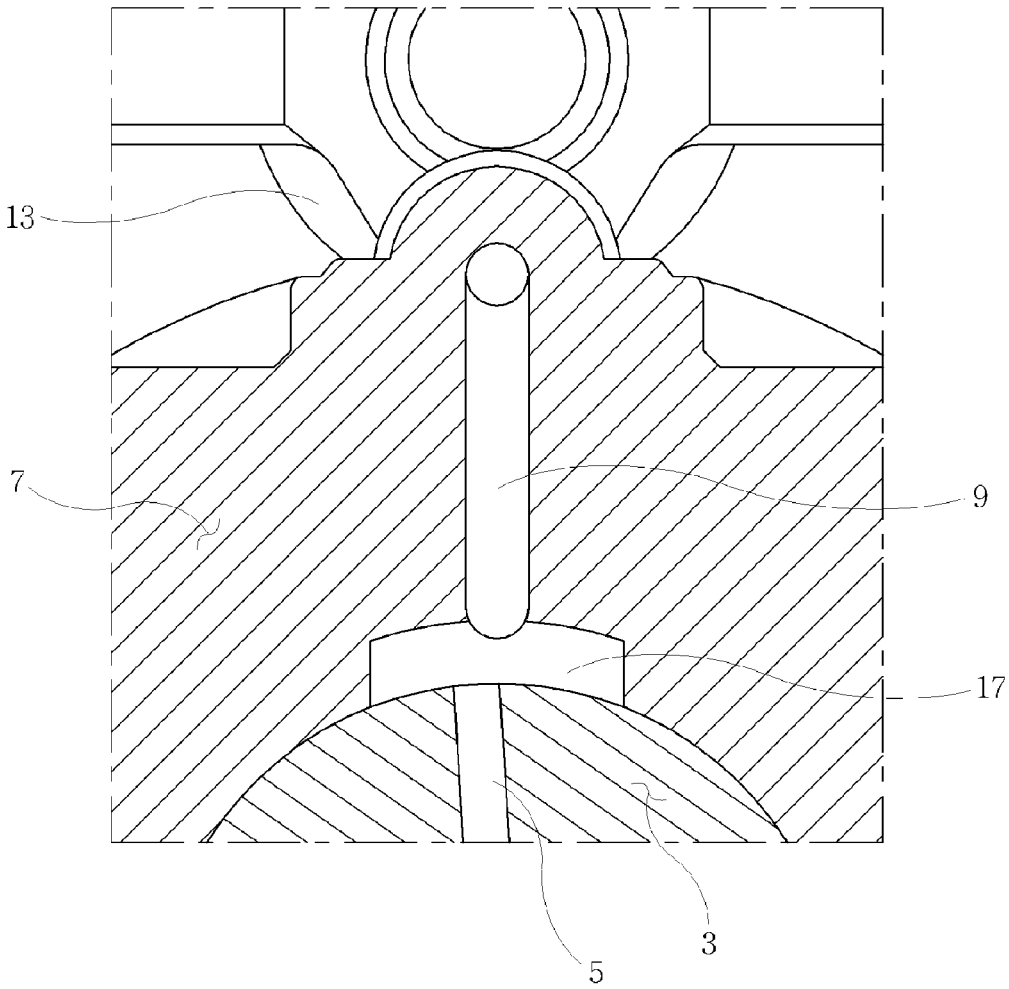
FIG. 4 is a view showing in detail the main parts of FIG. 3.
Figure 5:
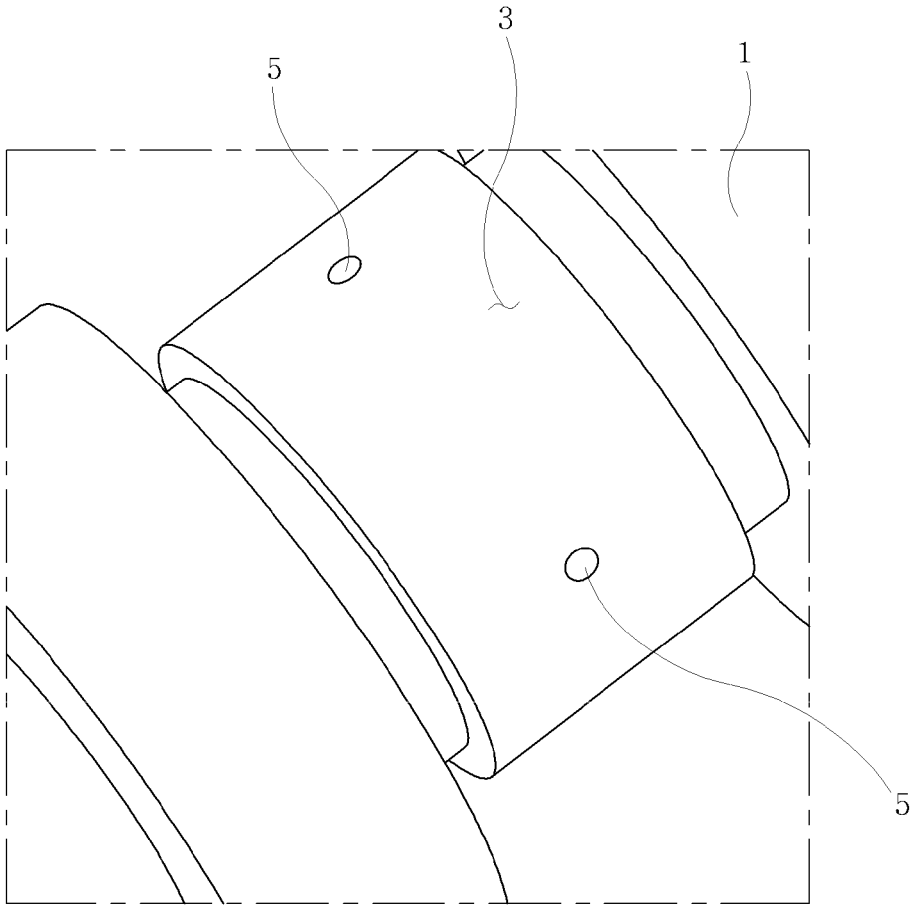
FIG. 5 is a view showing a journal of the camshaft of FIG. 3.
Figure 6:
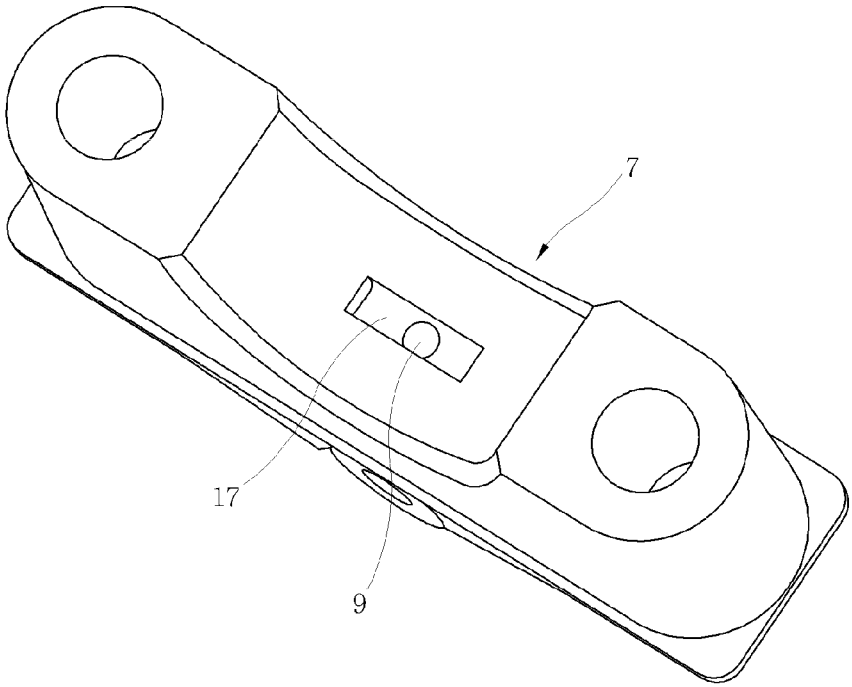
FIG. 6 is a view showing the cam cap of FIG. 3.

Oil supply holes 5 may be formed in the same number as the noses 11*a* of pump-driving cam 11 in the protrusion direction of the noses and connection groove 17 allows oil supply holes 5 to communicate with the oil channel 9 only in the sections where the operational member 13 of the pump-driving cam 11 is in contact with the noses 11*a*. The section may range between contact points 30, 40 or 50 of the basic circle C of pump-driving cam 11 and the outer profile of the noses 11*a* as shown in FIG. 3.

That is, in the exemplary embodiment shown in the figures, the number of the noses of pump-driving cam 11 is four, and accordingly four oil supply holes 5 are formed in the protrusion direction of the noses in journal 3. Therefore, connection groove 17 allows oil supply holes 5 to communicate with the oil channel 9 to be supplied with oil only when the driving roller, which is operational member 13 of the fuel pump, is in the sections between contact points 30, 40 or 50 of the basic circle of pump-driving cam 11 and the outer profile of the noses.

Although oil may be supplied to oil supply holes 5 of the camshaft through the inside of a hollow camshaft 1 to form a oil passage 35 therein to supply oil to the oil supply holes 5, the oil may be supplied through an oil channel formed in the cylinder head equipped with journal 3 such that the oil supply holes communicate.

As described above, the oil supplied to oil supply holes 5 is supplied to oil channel 9 of the cam cap through the connection groove only when one of the oil supply holes communicates with connection groove 17 by rotation of camshaft 1.

In an exemplary embodiment of the present invention, an angle between both distal ends of the connection groove 17 with respect to a rotation axis of the camshaft 1 is substantially the same as an angle between contact points 30, 40 or 50 of outer profile of at least one nose and a basic circle of the camshaft 1.

The oil supplied to oil channel 9, as described above, is injected for lubrication through nozzle 15 to the contact portion between pump-driving cam 11 and operational member 13 of the fuel pump.

In an exemplary embodiment of the present invention, the circumferential length of the connection groove 17 may determine the time period of the lubrication.

In this process, since the oil injected for lubrication is selectively injected only when the driving roller, which is operational member 13, is in the section from the basic circle of pump-driving cam 11 to the noses, as compared with when oil continuously supplied, oil consumption reduces and the capacity of the oil pump correspondingly reduces, and as a result, it is possible to achieve an effect of improving fuel efficiency.

It is possible to accomplish sufficient lubrication between pump-driving cam 11 and the driving roller if only to continually supply oil as described above and this is because the oil is sufficiently supplied in the sections from the basic circle of the pump-driving cam to the noses where the highest contact pressure is generated between the pump-driving cam and the driving roller.

For convenience in explanation and accurate definition in the appended claims, the term "outer" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lubrication system for a fuel pump of an engine, comprising:

at least one oil supply hole formed radially in a journal of a camshaft;

an oil channel formed in a cam cap rotatably connected to the journal of the camshaft and selectively communicating with the at least one oil supply hole;

a nozzle formed in the cam cap and being in fluid connection with the oil channel to inject oil to a contact portion between a pump-driving cam of the camshaft and an operational member of the fuel pump driven by the pump-driving cam; and a fluid communication control member selectively connecting the oil channel and the at least one oil supply hole in accordance with rotation of the camshaft, wherein the fluid communication control member is a connection groove formed in a journal contact surface of the cam cap across the oil channel with a predetermined length along a rotational direction of the at least one oil supply hole to fluid-communicate with the oil channel.

2. The lubrication system as defined in claim 1, wherein the camshaft is hollow to form an oil passage therein and the at least one oil supply hole fluid-communicates with the oil passage of the camshaft.

3. The lubrication system as defined in claim 1, wherein an angle between both distal ends of the fluid communication control member with respect to a rotation axis of the camshaft is substantially the same as an angle between contact points of outer profile of at least one nose and a basic circle of the camshaft.

4. The lubrication system as defined in claim 1, wherein the at least one oil supply hole is formed in the same number as at least one nose of the pump-driving cam in the protrusion direction of the at least one nose, and the connection groove allows the at least one oil supply hole to fluid-communicate with the oil channel only when the connection groove is disposed in an angular section between contact points of outer profile of the at least one nose and a basic circle of the pump-driving cam.

5. The lubrication system as defined in claim 1, wherein the fluid communication control member is a connection groove formed in a contact surface of the journal with the cam cap in a circumferential direction of the journal across the at least one oil supply hole to communicate with the at least one oil supply hole.

6. The lubrication system as defined in claim 5, wherein an angle between both distal ends of the fluid communication control member with respect to a rotation axis of the camshaft is substantially the same as an angle between contact points of outer profile of at least one nose and a basic circle of the camshaft.

7. The lubrication system as defined in claim 5, wherein the at least one oil supply hole is formed in the same number as at least one nose of the pump-driving cam in the protrusion direction of the at least one nose, and the connection groove allows the at least one oil supply hole to fluid-communicate with the oil channel only when the connection groove is disposed in an angular section between contact points of outer profile of the at least one nose and a basic circle of the pump-driving cam.

* * * * *